United States Patent [19]

Preddey et al.

[11] Patent Number: 4,498,327

[45] Date of Patent: Feb. 12, 1985

[54] CYLINDER LOCKS AND KEYS THEREFOR

[75] Inventors: Brian F. Preddey, Miranda; Laurence P. Mills, Crows Nest, both of Australia

[73] Assignee: Taboola Pty. Ltd., New South Wales, Australia

[21] Appl. No.: 362,795

[22] Filed: Mar. 29, 1982

[30] Foreign Application Priority Data

Mar. 30, 1981 [AU] Australia ..... PE8207
Jul. 8, 1981 [AU] Australia ..... PE9648

[51] Int. Cl.[3] ..... B21D 53/42

[52] U.S. Cl. ..... 72/341; 70/401; 76/110

[58] Field of Search ..... 72/379, 341, 338, 324, 72/332; 76/110; 70/401, 407; 409/81

[56] References Cited

U.S. PATENT DOCUMENTS

| | | | |
|---|---|---|---|
| 570,032 | 10/1896 | Luebbers | 70/401 |
| 1,823,547 | 9/1931 | Kaefer | 72/340 |
| 2,620,649 | 12/1952 | Bernardo . | |
| 3,736,780 | 6/1973 | Singer . | |
| 3,754,422 | 8/1973 | Stackhouse | 70/401 |
| 3,968,668 | 7/1976 | Epstein . | |
| 4,099,398 | 7/1978 | Lipschultz . | |

FOREIGN PATENT DOCUMENTS

| | | |
|---|---|---|
| 337838 | 6/1921 | Fed. Rep. of Germany . |
| 1428504 | 3/1969 | Fed. Rep. of Germany . |
| 2113008 | 10/1971 | Fed. Rep. of Germany . |
| 2924990 | 7/1980 | Fed. Rep. of Germany . |
| 2124008 | 9/1972 | France . |
| 544868 | 1/1974 | Switzerland . |
| 1223142 | 2/1971 | United Kingdom . |
| 1517704 | 7/1978 | United Kingdom . |
| 2055948 | 3/1981 | United Kingdom . |

*Primary Examiner*—Lowell A. Larson
*Attorney, Agent, or Firm*—Lester Horwitz

[57] ABSTRACT

A method of forming a key including providing a key blank of V-shaped transverse cross section so as to have two blade portions joined by a base portion. The method further includes forming teeth on the blade portions and then bending the blank to a substantially U-shaped transverse cross section.

4 Claims, 13 Drawing Figures

FIG. 3
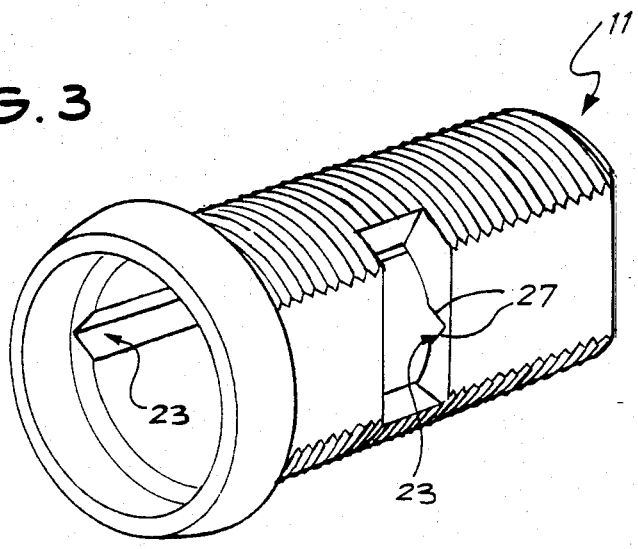
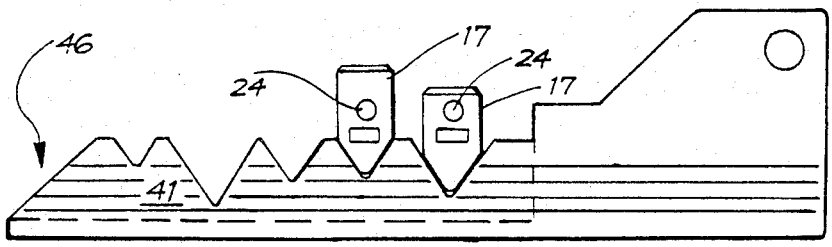
FIG. 4
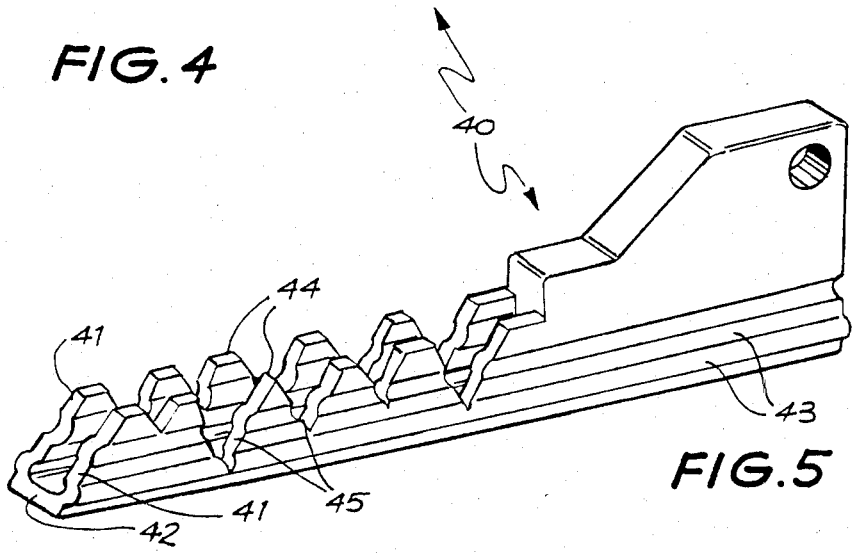
FIG. 5

50
50A
50B
51
52
53
54
55
56
57
9
11
13

CYLINDER LOCKS AND KEYS THEREFOR

The present invention relates to cylinder locks and more particularly to keys therefor.

Known cylinder locks employing a conventional barrel require the use of upper pins which bear against the locking pin and bias same toward the keyway. Thus the barrel is not self contained which is a disadvantage. In particular the use of upper pins increaes the size of the lock. Still further, most cylinder locks do not offer a large number of possible lock combinations which has the disadvantage that the locks are more easily picked while it limits the number of combinations available to users. Additionally conventional keys, due to their height which is required for strength, increase the size of the lock by requiring the use of upper pins.

Where large combinations are available it has been found that these types of cylinder locks employ a large number of different parts and accordingly are generally expensive to manufacture due to their complexity.

It is still further desirable in locks generally that there be control over the key blanks since it is a disadvantage of known locks that the keys are too easily reproduced thus greatly reducing the security of the lock.

It is an object of the present invention to overcome or substantially ameliorate the above disadvantages.

There is disclosed herein a key blank of generally "V-shaped" transverse cross-section so as to provide two longitudinally extending transversely converging key blades joined by a longitudinal base.

There is also disclosed herein a method of forming a key, said method comprising the steps of:

(a) providing a key blank of generally "V-shaped" transverse cross-section so as to define two longitudinally extending transversely converging key blades joined by a longitudinal base;

(b) cutting a key profile in at least one of the blades so as to provide at least one recess extending inwardly from the edge of the blade; and (c) bending the blades toward each other so as to define in combination with the base a key of generally "U-shaped" transverse cross-section.

A preferred form of the present invention will now be described by way of example with reference to the accompanying drawings, wherein:

FIG. 3 is a schematic perspective view of a housing to receive the barrel of FIGS. 1 and 2;

FIG. 4 is a schematic side elevation of a key adapted to be used with the barrels of FIGS. 1 and 2 with the key engaged by locking pins;

FIG. 5 is a schematic perspective view of the key of FIG. 4;

Figure 1:
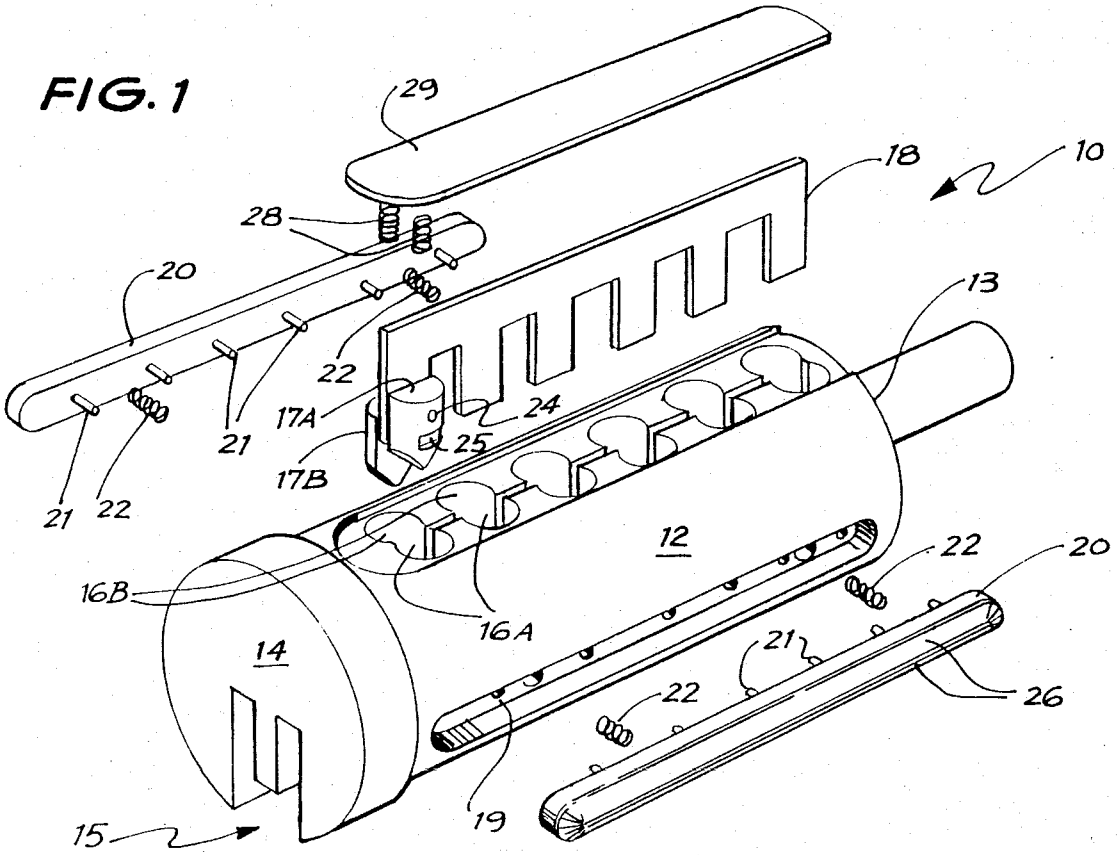
FIG. 1 is a schematic perspective parts exploded view of a barrel for a cylinder lock.

In FIG. 1 there is schematically depicted a barrel 10 of a cylinder lock, which barrel 10 is adapted to be located within the housing 11 of FIG. 3. The barrel 10 includes a generally cylindrical body 12 having end faces 13 and 14. Formed in the body 12 is a keyway 15 which extends longitudinally inwardly from the face 14 to adjacent the face 13. The keyway 15 has a configuration adapted to receive particularly the key of FIGS. 4 and 5, however it may be altered to fit any one of the keys depicted in FIGS. 6 to 9.

Extending inwardly from the outer cylindrical periphery of the body 12 are a plurality of bores 16 which are divided into two longitudinally extending sets 16A and 16B. Additionally the bores 16 are arranged in pairs consisting of a bore from each set. Slidably received within each bore is a locking pin 17, which locking pins are divided into sets 17A and 17B. The locking pins 17A and 17B are held in a spaced parallel relationship by a plate 18 which in combination with the internal surfaces of the bores 16, restrict the locking pins 17 to moving in a direction generally perpendicular to the longitudinal axis of the body 12.

The body 12 is further provided with two longitudinally extending recesses 19 which are adapted to receive locking bars 20 which have locking projections 21. The locking bars 20 are biased to a radially outer position by means of springs 22. The locking bars 20 are slidably received within the recesses 19 so as to be movable from a radially inner position allowing rotation of the barrel 10 to a radially outer position engaged within the grooves 23 (FIG. 3) formed on the internal surfaces of the housing 11. In this radially outer position the barrel 10 is prevented from rotating by the locking bars 20.

Each of the pins 17 is provided with a recess 24 which is dimensioned to receive a locking projection 21 so that upon location of the recesses 24 in the correct position, the corresponding locking projection is engageable therein. Additionally each pin 17 may be provided with a dummy recess 25 which is provided to hinder picking of the lock.

Upon a key of correct configuration being inserted in the keyway 15, each of the pins 17 is located so that the locking projections 21 are receivable within the recess 24 thereby allowing the locking bars 20 to move to a radially inner position. Thus the barrel 10 may be rotated. If the recesses 24 are not all correctly aligned, then the locking bars are prevented from moving thus retaining the barrel 10 in a locking position. As can be seen from FIGS. 1 and 3, the locking bars 20 are provided with converging surfaces 26 which cooperate with converging surfaces 27 forming the groove 23 to force the locking bars 20 radially inwardly. The locking pins 17 are biased to a position projecting inwardly of the keyway 15 by means of springs 28 which bear against the locking pins 17 and a cover plate 29.

Figure 2:
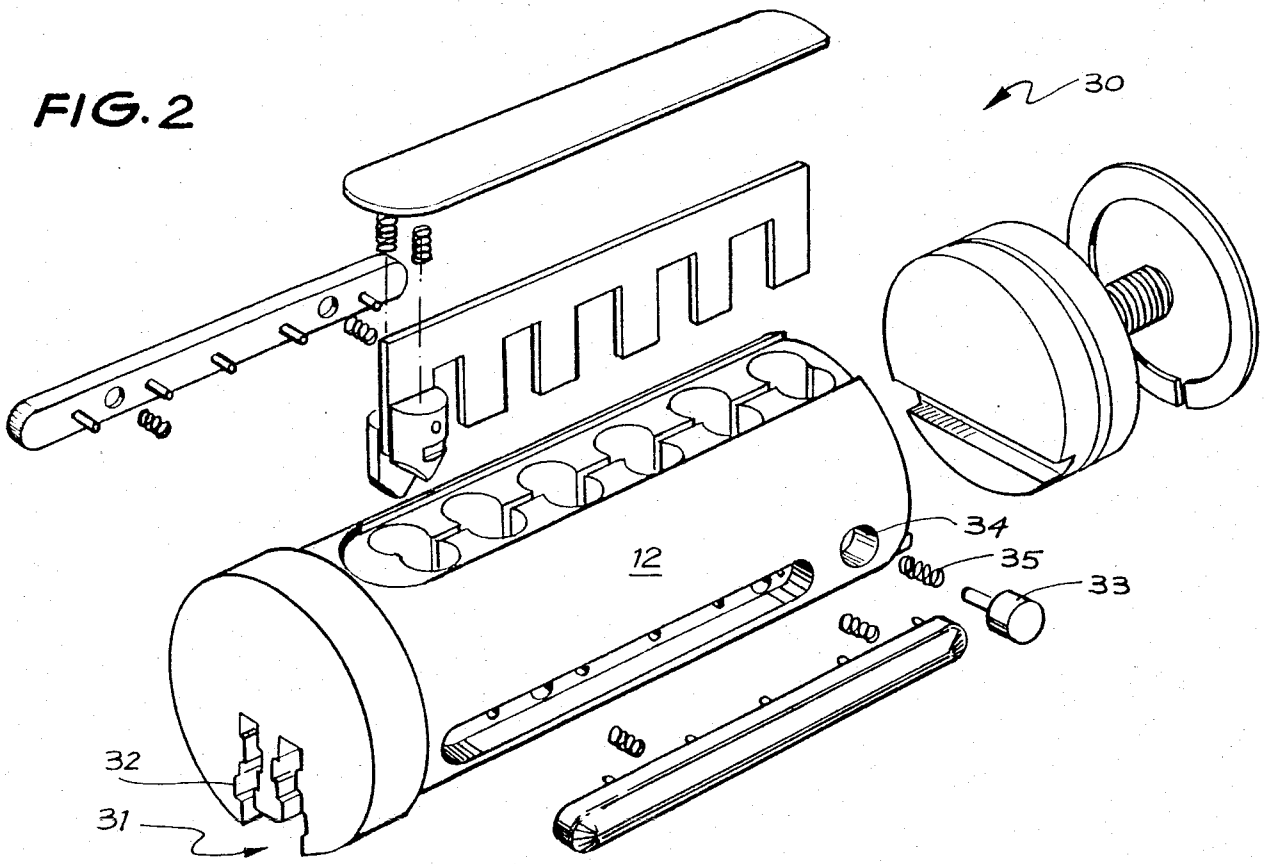
FIG. 2 is a schematic parts exploded view of a further barrel to that of FIG. 1.

Turning now to FIG. 2 wherein there is schematically depicted a barrel 30 which is of very similar construction to the barrel 10 of FIG. 1. The difference being that the barrel 30 has a keyway 31 provided with longitudinally extending flutes 32 which again increases the number of combinations available for the lock. Additionally there is provided further pins 33 which are adapted to engage an annular groove formed on the internal surfaces of the housing 11. These further pins 33 are adapted to retain the barrel 30 within the housing 11 until a key of correct combination is inserted allowing retraction of these further pins 33. The pins 33 are slidably received within passages 34 formed in the body 12 with a spring 35 being provided to bias the pins 33 to their radially outer position retaining the barrel 30 within the housing 11.

Turning now to FIGS. 4 and 5, there is schematically depicted a key 40 of generally U-shaped transverse cross section so as to have upwardly extending key blades 41 joined by a base 42. There is schematically illustrated in FIG. 4 two locking pins 17 engaged with the teeth of the blades 41 so that the passages 24 are aligned thus allowing entry of the locking projections 21. The key 40 is also provided with longitudinally extending flutes and ridges 43 adapted to increase the number of combinations available to the lock. It should be particularly appreciated that the teeth 44 formed in the blades 41 are separated by valleys 45 which may extend downwardly to a limit position adjacent the base 42. By providing the key 40 with blades 41 joined by base 42, the valleys may extend to adjacent the base 42 without the key 40 being weakened to an extent such that it is easily deformed during use.

A particular feature provided in the key 40 is the leading portion 46 which is substantially of a chisel configuration enabling the barrel 10 to be self contained in that outer locking pins are not required. By providing the key 40 with the leading portion 46, the locking pins 17 may extend further into the keyway 15.

A further advantage of the key 40 in that the valleys 45 are more easily formed since the blades 41 are in a spaced parallel relationship.

Figure 6:
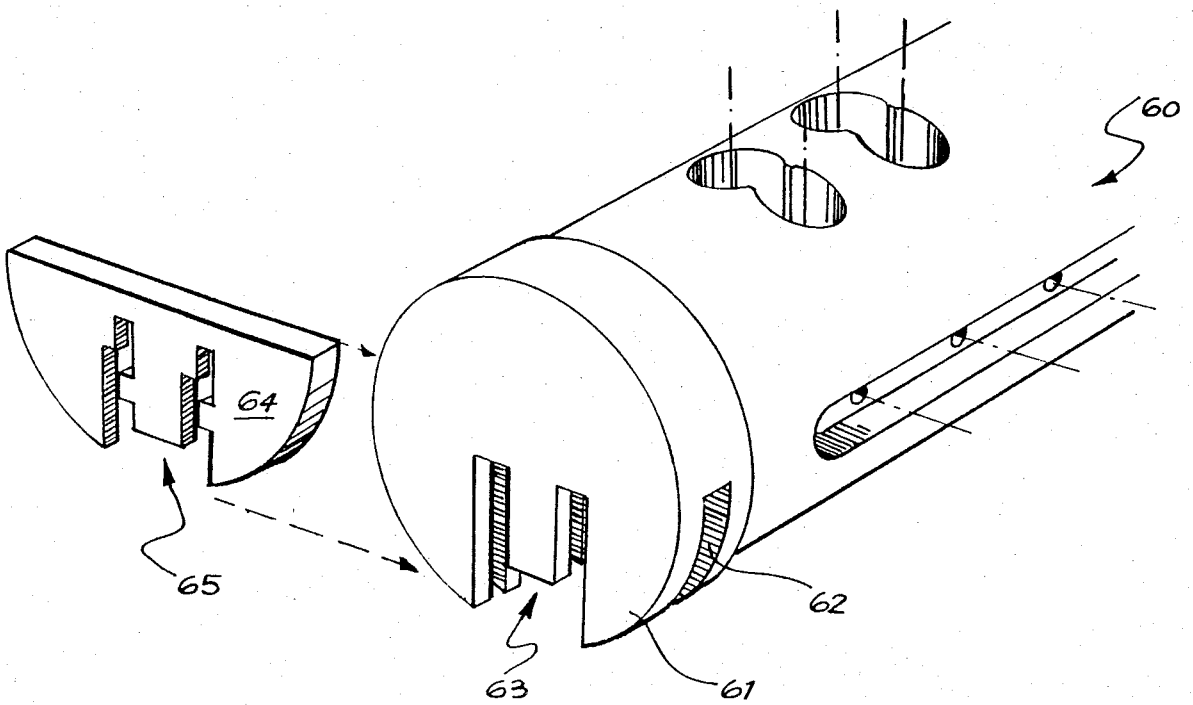
FIG. 6 is a schematic perspective view of a barrel and front portion of a cylindrical lock.

Turning now to FIG. 6, there is schematically depicted the barrel 60 of a cylindrical lock. The barrel 60 has a front face 61 which defines a key slot 63. The key slot 63 is shaped so as to accommodate a wide range of key configurations of the type suitable for the barrel 60. The front face 61 is further provided with a transversely extending slot which is adapted to receive a key selection member 64 which has a key slot 65 which is aligned with the slot 63 when the member 64 is located within the slot 62. By providing an assembly member 64, a standard barrel 60 may be provided with individual key combinations being selected by interchangeable key selection members 65.

Figure 7:
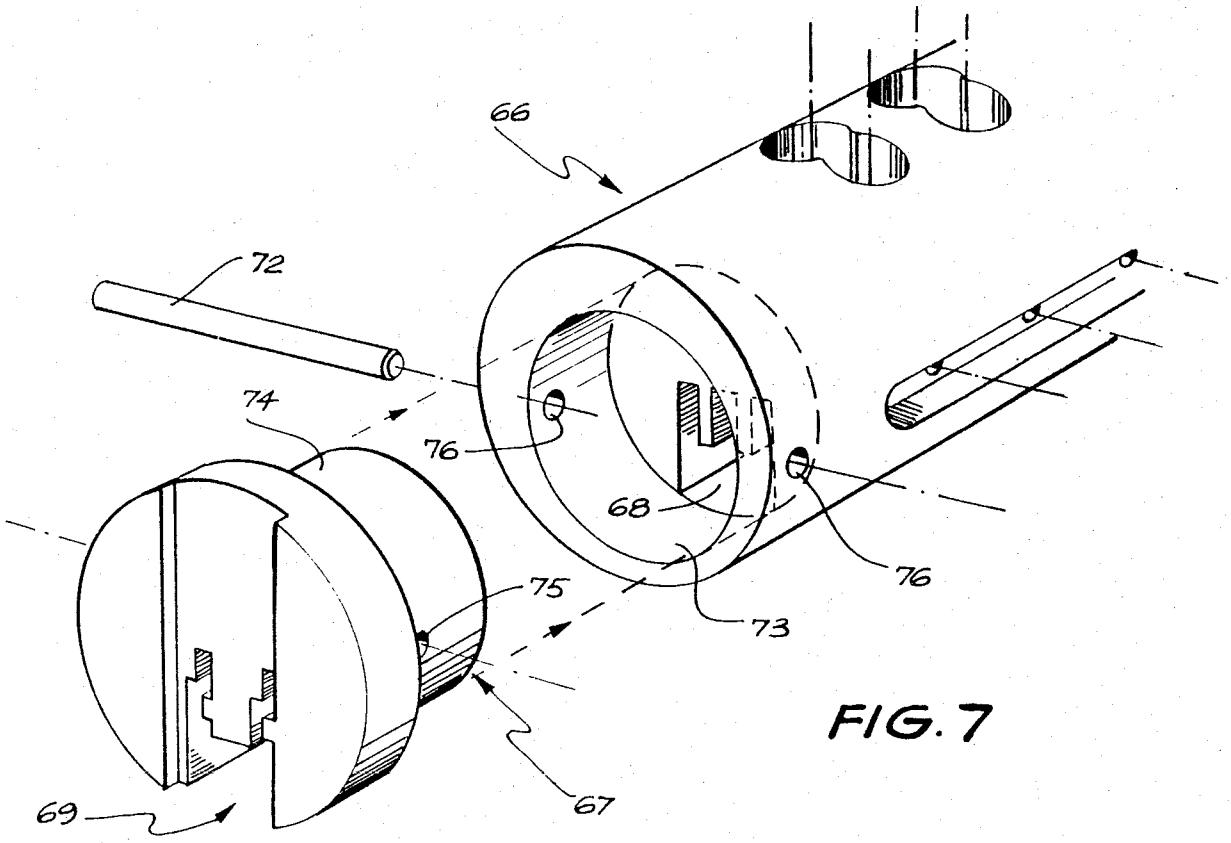
FIG. 7 is a schematic perspective view of a further barrel and front portion of a cylindrical lock.
Figures 8, 9, 10, 11, 12, 13:
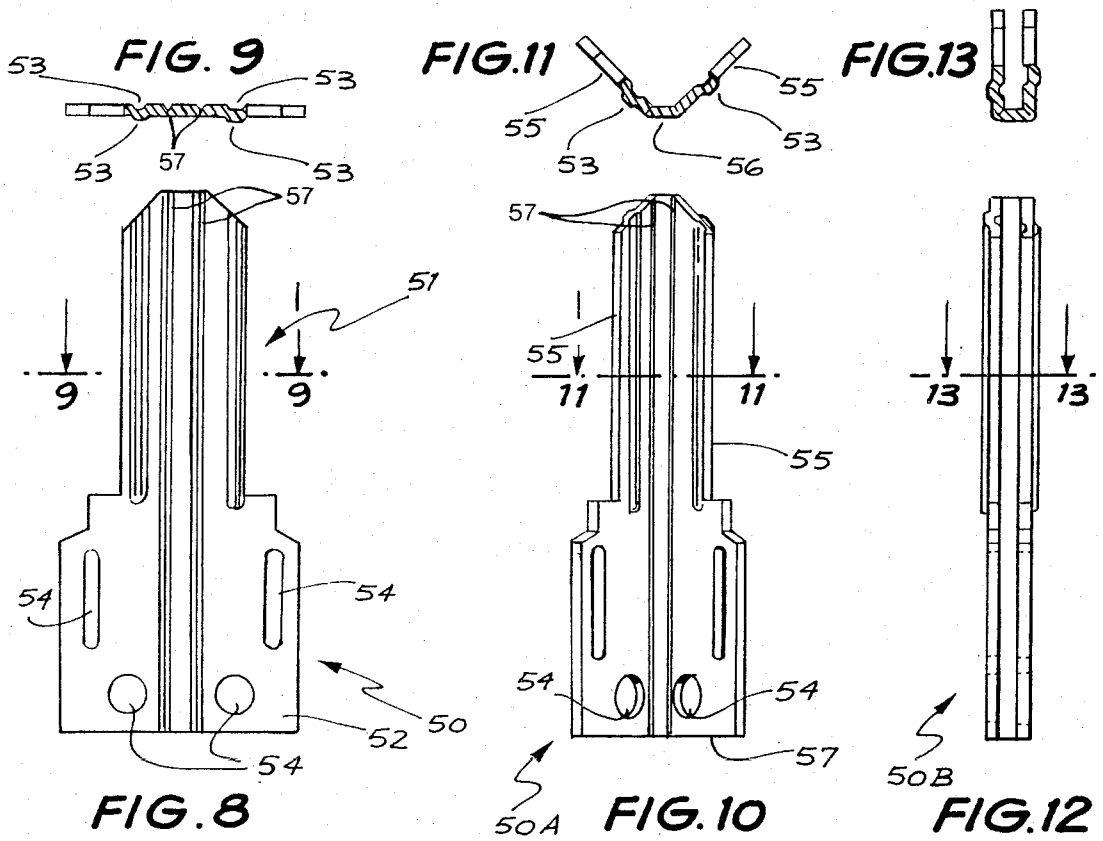
FIG. 8 is a plan view of a generally planar key blank.
FIG. 9 is an end elevation of the blank of FIG. 8 sectioned along the line 9—9.
FIG. 10 is a plan view of the blank of FIG. 8 partly deformed so as to provide an intermediate key blank.
FIG. 11 is an end elevation of the blank of FIG. 10 sectioned along the line 11—11.
FIG. 12 is a plan view of a key formed from the intermediate key blank of FIG. 11.
FIG. 13 is an end elevation of the key of FIG. 12 sectioned along the line 12—12.

Turning now to FIG. 7, the barrel 66 is similar to that of FIG. 11 in that it is provided with a removable front portion 67. Further, the barrel 66 is provided with a key slot 68 adapted to receive a large variety of key configurations which are suitable to be used with the barrel 60. Additionally, the barrel 60 is provided with a central cylindrical aperture 73 adapted to receive a cylindrical projection 74 forming part of the front portion 67. Additionally, there is provided a passage 75 extending through the cylindrical projection 74 which is aligned with passages 76 formed in the barrel 66 to allow the insertion of a pin 72 to retain the front portion 67 in its operative position.

The front portion 67 (which acts as a key selection member) has a key slot 69 which is adapted to select a particular key configuration. Accordingly the barrel 66 is adapted to be used as a standard barrel with particular key configurations being selected by the front portion 67.

Finally with reference to FIGS. 9 to 12 wherein there is schematically depicted the method of forming a key. Particularly with reference to FIGS. 8 and 9, the initial key blank 50 is provided with a blade portion 51 and a head portion 52. The blade portion 51 has longitudinal recesses or ribs 53 which may be varied to alter the combination provided by the key. These recesses or ribs 53 would match the flutes 32 of FIG. 2 or the configuration of the key slot of the key selection members 64 and 67 of FIGS. 6 and 7. The head portion 52 is provided with recesses or holes 54 to securely engage a plastic key head.

It is proposed to provide locksmiths with intermediate key blanks as shown in FIGS. 10 and 11. Accordingly the blank 50 is bent about two longitudinally extending axes so as to provide an intermediate key blank 50A having a blade portion 51 with a "V-shaped" transverse cross-section. Thus the intermediate blank 50A has key blades 55 joined by a base 56. As can be seen in FIGS. 10 and 11 the head portion 52 is also bent so as to provide the head parts 57.

It is proposed to limit the reproduction of keys according to this specification by selectively providing bending machines which will receive only a particular intermediate key blank. Accordingly a particular locksmith will be limited to selling a predetermined configuration as far as grooves or ridges 53 are concerned.

Finally the finished key 50B is formed by cutting key profiles in the blades 55 and then further bending the blades so as to provide the key 50B with a substantially "U-shaped" transverse cross-section. Additionally a plastic head would be securely located between the head portions 57.

The blank 50 is also provided with two grooves 57 which extend along the two longitudinal axes about which the blank 50 is bent. The grooves 57 aid in the accurate bend of the blank 50 to form the intermediate blank 50A. To further aid in bending the blank 50A, the grooves 57 are dimensioned so as to not be totally closed when the intermediate blank 50A is formed. The remaining unclosed part of the grooves 57 enables the easy formation of the key 50B.

What we claim is:

1. A method of forming a key, said method comprising the steps of:

(a) providing a key blank of generally v-shaped transverse cross section so as to define two longitudinally extending transversely converging key blades joinded by a longitudinal base;

(b) cutting a key profile in at least one of the blades so as to provide at least one groove extending inwardly from a longitudinal edge of the said one blade; and (c) bending the blades towards each other so as to define in combination with the base a key of generally u-shaped transverse cross section.

2. The method of claim 1 wherein said key blank has two longitudinal recesses extending substantially along the joint of each blade with said base.

3. The method of claim 1 wherein said key profile is formed on each of the longitudinal edges of the blades.

4. The method of claim 2 wherein said key profile is formed on each of longitudinal edges of the blades.

* * * * *